US012146334B2

(12) United States Patent
Banjo

(10) Patent No.: US 12,146,334 B2
(45) Date of Patent: Nov. 19, 2024

(54) CONVERTIBLE CARRYING CASE AND SECUREMENT SYSTEM FOR A POST

(71) Applicant: Diana Banjo, Carson, CA (US)

(72) Inventor: Diana Banjo, Carson, CA (US)

( * ) Notice: Subject to any disclaimer, the term of this patent is extended or adjusted under 35 U.S.C. 154(b) by 102 days.

(21) Appl. No.: 17/687,681

(22) Filed: Mar. 7, 2022

(65) Prior Publication Data

US 2023/0279689 A1 Sep. 7, 2023
US 2023/0407664 A9 Dec. 21, 2023

Related U.S. Application Data

(60) Provisional application No. 63/157,915, filed on Mar. 8, 2021.

(51) Int. Cl.
*E04H 12/34* (2006.01)

(52) U.S. Cl.
CPC ..... *E04H 12/34* (2013.01)

(58) Field of Classification Search
CPC ..... E04H 12/34
See application file for complete search history.

(56) References Cited

U.S. PATENT DOCUMENTS 5,248,140 A * 9/1993 Mower ..... A63B 63/083 473/484
5,259,612 A * 11/1993 Matherne ..... A63B 71/023 473/484
7,407,453 B2 8/2008 Shannon
7,431,672 B2 10/2008 Van Nimwegen
7,691,014 B2 * 4/2010 Nye ..... A63B 63/083 473/481
8,028,448 B2 10/2011 Amrani
8,599,097 B2 * 12/2013 Intravatola ..... H04R 5/02 206/573

(Continued)

FOREIGN PATENT DOCUMENTS

CN 107281723 A * 10/2017
CN 209475507 U * 10/2019

OTHER PUBLICATIONS

Insport Tarmak B500 box video on youtube.com dated Apr. 7, 2021, https://www.youtube.com/watch?v=ZdwWVFm9Tbo (Year: 2021).*

(Continued)

*Primary Examiner* — Terrell L McKinnon
*Assistant Examiner* — Ding Y Tan
(74) *Attorney, Agent, or Firm* — Metropolis IP Group, LLC; Eric Kang

(57) ABSTRACT

A convertible carrying case and securement system for a post comprising a case comprising of at least five contiguous panels that form a substantially hexahedral volume, a retractable pull handle on one end of said case, at least one pair of wheels on the distal end of said case at the opposite end of said retractable pull handle, said case having a plurality of straps and/or handles attached to at least one of the outside panel surfaces, wherein said five panels include the case floor, two case side panels, a wheel-side panel closest to said pair of wheels, and a panel parallel to said wheel-side panel but connecting the opposite edges of said side panels, a post comprising at least a base post or stump, wherein one end of the said base post or stump is within said case during the post's deployment.

40 Claims, 9 Drawing Sheets

(56) References Cited

U.S. PATENT DOCUMENTS

| | | | | |
|---|---|---|---|---|
| 8,651,492 | B1 * | 2/2014 | Cappuccio | A63B 71/0036 273/398 |
| 2007/0191148 | A1 * | 8/2007 | Shannon | A63B 71/023 473/483 |
| 2022/0288475 | A1 * | 9/2022 | Le Cunff | A63B 63/083 |

OTHER PUBLICATIONS

Melissa Breyer Jun. 5, 2017 online article on treehugger.com titled "16 Clever Uses for Binder Clips", https://www.treehugger.com/clever-uses-for-binder-clips-4863753 (Year: 2017).*

Bison playtime adjustable portable basketball stand online product page, archive.org dated: Jul. 9, 2016, https://www.sportsadvantage.com/bison-playtime-adjustable-portable-basketball-standard (Year: 2016).*

Fandamei shelf support pins sold on amazon, dated Jun. 29, 2019, https://www.amazon.com/FANDAMEI-Support-Cabinet-Furniture-Shelves/dp/B07TMKX499 (Year: 2019).*

Kovot portable kids mini basketball set in carry case sold on amazon dated Oct. 28, 2019, https://www.amazon.com.au/Kovot-Portable-Basketball-Adjustable-Backboard/dp/B07ZPF39SK (Year: 2019).*

* cited by examiner

CONVERTIBLE CARRYING CASE AND SECUREMENT SYSTEM FOR A POST

CROSS-REFERENCE TO RELATED APPLICATIONS

The present application claims priority to provisional patent application No. 63/157,915 filed on Mar. 8, 2021, disclosures of which are incorporated herein at least by reference.

FIELD OF THE DISCLOSURE

The field of the disclosure described herein generally relates to a portable structure.

BACKGROUND OF THE DISCLOSURE

Vertical posts are ubiquitous structures that serve a wide variety of purposes relating to a necessity requiring height. One class of applications comprises of posts used in athletics to elevate attachments for goal structures such as a basketball backboard and hoop or a boxing punching element, elevate obstacles/borders such as a volleyball net, or be used as obstacles themselves such as a slalom post. Another class of applications comprises of posts used to elevate signs or signals for improved far-field visibility and examples include signs/signals for real estate for sale/lease, events, advertisement, and vehicle traffic control. Other devices that use vertical posts include but are not limited to an outdoor mailbox, lamp, and outdoor gas heater.

In many instances, posts are fixed into the ground and are not readily portable. Portability, transportability, and storability can be important if, for example, one would like to quickly set up a basketball backboard and hoop assembly and after use, easily collapse the assembly into a storage case that can fit a regular passenger vehicle. Portable posts can also be important for realtors needing to set up, remove, or transport for sale/lease signs. A more traditional real estate sign requires one to hire contractors to dig a hole and erect a bulky, non-collapsible post in the front yard of a home to be sold. Such posts also typically require a pickup truck or large utility vehicle to transport.

Unfortunately, sufficiently easy portability, transportability, and storability are not yet truly offered. With existing purportedly "portable" and "transportable" basketball backboard and hoops, transportability is limited to moving the entire assembly and base a small distance along a ground surface without the appreciable potential to collapse the assembly for easy transport in a personal automobile, such as the common type described by Van Nimwegen (U.S. Pat. No. 7,431,672 B2). While a reasonably collapsible implementation taught by Shannon (U.S. Pat. No. 7,407,453 B2) discloses a couple of embodiments of a basketball backboard and hoop system with either telescoping tubes or hinged struts that help collapse the backboard and hoop into a storage box, this box is "preferably installed within the ground so that the post assembly attaches to a top cover therefore flush with the ground." Hence transportability is not possible.

Amrani (U.S. Pat. No. 8,028,448 B2) teaches embodiments of a collapsible real estate sign apparatus where the post is driven into the ground by a "hammer or mallet" or "rotary drive tool." An apparatus transportation embodiment discloses a case with an "optional handle" "to store and transport" the sign assembly. However, the disclosure does not teach of using a dual-purpose carrying case as the secure means to fix the post nor use the case as a container to hold ballasts.

Furthermore, not only is there no prior portable, transportable, storable post, but also no apparatus whose orientation is adjustable by a dual-purpose carrying case. Finally, there is no prior post securement apparatus with an integrated diagnostic means to assess the verticalness of said post to facilitate optimal adjustments. Such adjustments are necessary to prevent, for example, a tilted basketball backboard and hoop on an uneven or non-level surface.

SUMMARY OF THE DISCLOSURE

The present disclosure addresses all previously mentioned issues with a novel system comprising of a portable case and post mechanism. Embodiments of the present invention are designed such that a height-adjustable post can be quickly and easily erected or collapsed by a single adult quickly without the need for any tools. When the post is in the stored position, the case is capable of being transported by one adult and loadable onto a passenger vehicle. Furthermore, the present invention includes embodiments that position the case at some adjustable distance from the ground surface and integrate two construction levels that provide feedback on the level of flatness so that the post is aligned as true vertical as possible.

This disclosure presents two main convertible carrying case and securement system embodiments, EMB1 and EMB2. Both system embodiments have a case comprised of at least five contiguous panels that enclose a substantially hexahedral space if an optional sixth panel or lid is added to close the case. In addition to storage, said case acts as a securement foundation or base, with at least a pair of wheels on one end of said case, preferably a retractable pull handle on the opposite end of said wheels, optional straps attached to the two long side panels of said case, a construction level along with one of the long side panels of said case, another construction level along with one of the spanwise panels of said case, and four adjustable case support structure (ADJSS) sub-assemblies that each have a foot sub-assembly that incorporates one from a list comprising a plate, a ground screw, suction cups, or stake that are attached on one end of a threaded shaft. Preferably attached on the opposite distal end of each threaded shaft, is a knob, or generally a torque application element. The ADJSS allows users to compensate for non-level surfaces when setting up a vertical post.

The first system embodiment, EMB1 further comprises a base tube, preferably integrated with a T-shaped structural element (hereinafter called a "T-bar") that can pivot about the axis normal to the base tube. Most notably, when said base tube is deployed for duty and not stored, the post projects upward from one of the distal ends of the case. The base tube and T-bar are preferably hollow tube-like structures. Said base tube can be part of an overall telescoping post with optional additional tube segments to extend the maximum height of the overall post. The extendable post segments are held in position with quick-release lock pins. A collar-connecting rod-slider mechanism can help guide the overall post assembly between the stored and deployed position. A quick-release lock pin positioned through lined up holes on both the slider and slider track provides the constraining force to prevent rotation of the base tube during deployment.

The second system embodiment, EMB2, alternatively comprises a proximally located stump that is structurally integrated with the case. Said stump can slide relative to a circular single-segment post or multiple-segment telescoping post and be fixed together with quick-release lock pin(s).

A variety of attachments can be fixed around the post or the most fully extended segment of a telescoping post with attachments preferably wrapping around or sliding in the top-most tube segment and fixed by a quick-release lock pin positioned through lined up holes in both the attachment and top-most tube segment. The overall geometry of said attachments is particular to the intended application.

For EMB1, the attachments can include but are not limited to a basketball backboard and hoop apparatus, a boom for suspending a real estate sign, one side of a volleyball or tennis net, batting cage tunnel, boxing punching element, and multi-sports barrier backstop. For EMB2, the attachments can include but are not limited to event/traffic signs, barricades, retractable belt or safety stanchions, signage and floor signs, gas lamp, lighting fixture, heater, gun barrel platform, cocktail tables, banner frames, one side of a volleyball or tennis net, a tetherball, batting cage tunnel, and multi-sports barrier backstop.

To help keep either EMB1 or EMB2 in place during use, weights may be placed in the case. An embodiment of the mating surface of said feet is made of high friction material. Applications of either EM1 or EMB2 over a soft ground surface have a foot sub-assembly embodiment that is preferable one from a list comprising a ground screw or alternatively a stake. An embodiment of EMB1 or EMB2 includes no feet or removed feet and the bottom or belly of the case in contact with the ground is made from high friction material. As for storage and transport, embodiments of either EMB1 or EMB2 include side-by-side coupling or grouping in a stack.

BRIEF DESCRIPTION OF THE DRAWINGS

The drawings are provided to facilitate understanding in the detailed description. It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

DETAILED DESCRIPTION OF THE DISCLOSURE

I) EMB1 Embodiment (100A, REF. FIGS. 1-5)

Figure 1:
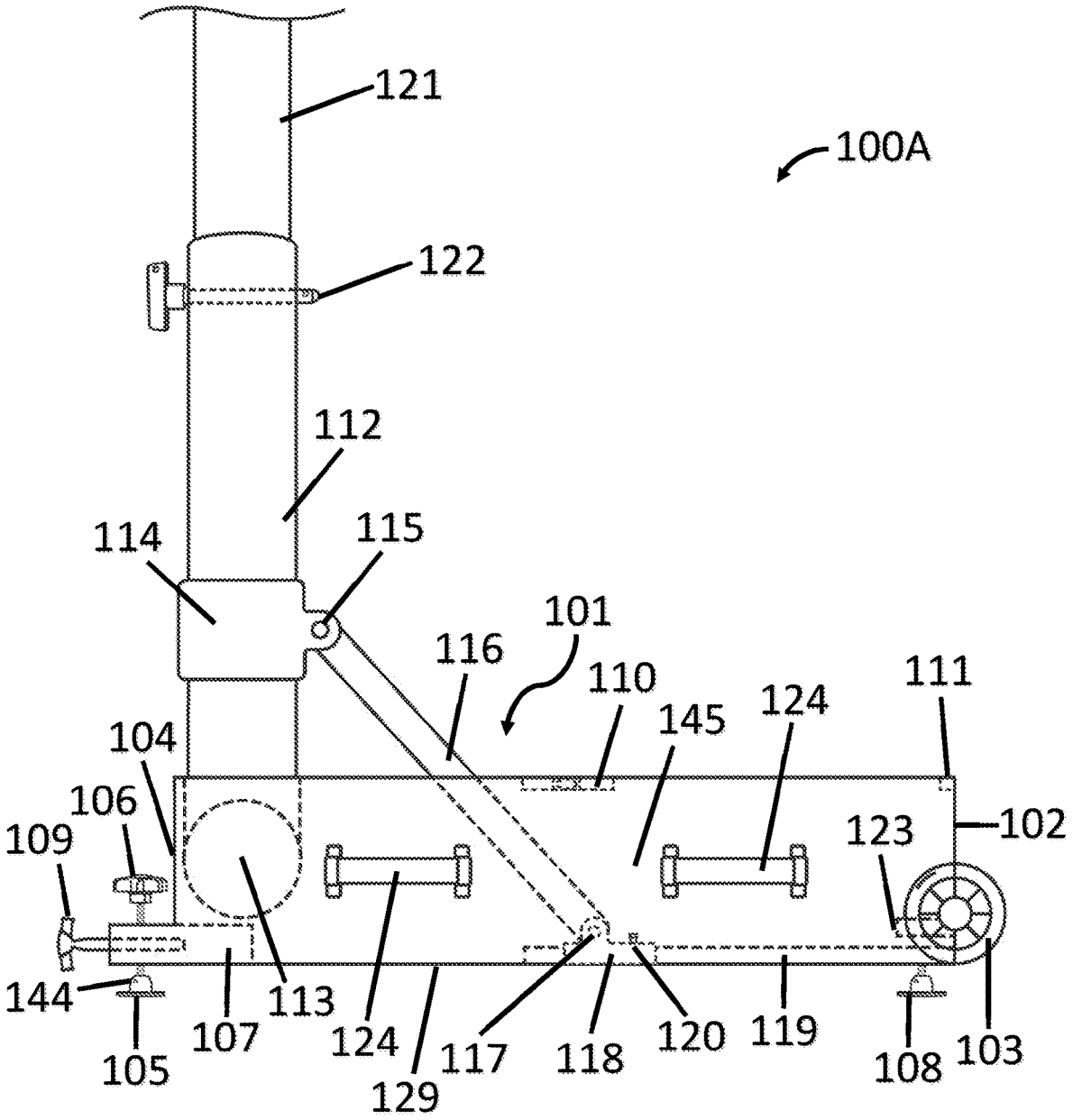
FIG. 1 is a side view of EMB1 with its post in the deployed position.
Figure 2:
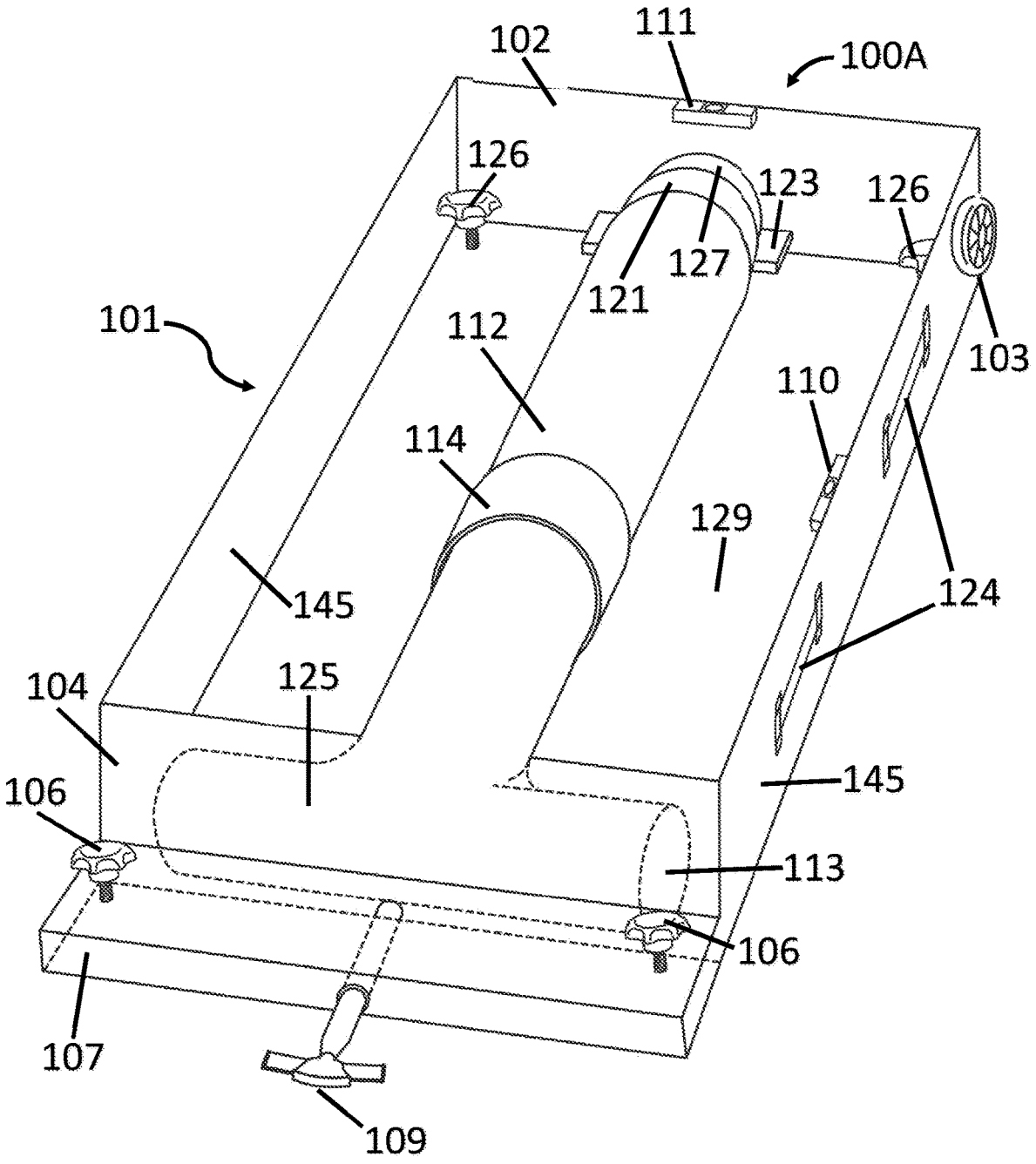
FIG. 2 is an oblique view of EMB1 with its post in the stored position.

FIGS. 1 and 2 show the first system embodiment, EMB1 (100A), of the invention, which notably has an offset position of the post when deployed. EMB1 (100A) comprises a case (101), which serves as the structural foundation of the post. Said case (101) comprises a wheel-side panel (102) that contains the axle housing(s) for a pair of wheels (103) as shown in FIG. 1. On the opposite side of the wheel-side panel (102) of said case (101) is a parallel tube-side panel (104). Connecting each edge of the wheel-side panel (102) and tube-side panel (104) is a floor (129) of said case (101). In addition, connecting the remaining edges of said floor (129), wheel-side panel (102), and tube-side panel (104) are the side panels (145) that are oriented along the longer dimensional orientation or major axis of said case (101). An optional lid (not shown) can close the case (101) when the post is in its stored position to form a substantially hexahedral outer profile.

When the post is deployed, one support embodiment has the case (101) elevated from the ground by four adjustable and removable support structure (ADJSS) sub-assemblies, one near each bottom corner of EMB1, as depicted in FIGS. 1, 3, 4, 6, 8, and 9. Each sub-assembly of said ADJSS comprises a pair of feet (105) nearest to the tube-side panel (104) and another pair of feet 108) nearest to the wheel-side panel (102).

Each foot (105, 108) comprises a plate that would be in contact with the ground surface during deployment of the post or storage. Embodiments of said foot (105, 108) have a plate-like bottom with a high grip surface for applications requiring high grip and have a rubber or synthetic equivalent lining the ground surface interfacing side of said plate. Connected on the opposite side of the ground-contacting portion of the plate is a substantially hemispherical element with a center-top borehole to accommodate a substantially threaded adjuster shaft. Each substantially hemispherical element of said foot (105, 108) has another small threaded borehole (144) where a fastening element such as a cone point set screw can be threaded in and substantially orthogonally engages the shank portion of said substantially threaded adjuster shaft so that said foot is securely fixed to the substantially threaded adjuster shaft.

Each substantially threaded shaft disposed through the floor (129) of the case (101) or a case extension (107), wherein bottom surface of case extension (107) is substantially coplanar with case floor (129) and juts out from the tube-side panel (104) sufficiently enough to place the ADJSS sub-assembly off the tube-side panel (104). Connected to each said substantially threaded shaft is a knob (106, 126). Said knobs allow users to turn the substantially threaded shaft and feet so that the ground clearance at each corner of the case (101) is adjusted and as well as the state of the overall post's vertical orientation without the need for any tools. The substantially threaded shafts connected to the knobs (126) at the wheel-side runs through a borehole structure (not shown) thick enough with a sufficient number of threads to engage the substantially threaded shafts and support the load. Torque can be supplemented with a surface embodiment of said knobs (106, 126) containing a cavity shape to allow engagement with a socket wrench drive and augment torque application from additional leverage provided by a wrench. FIG. 1 illustrates the full relation of the ADJSS sub-assemblies on the tube-side with the knob (106), foot (105), substantially threaded shaft connecting said knob (106) and foot (105) that is disposed through said case extension (107). An arrangement on the wheel-side of said case (101) similarly exists between the inside-case knob (126) and foot (108). The thickness of said case floor (129) and case extension (107) wherein said threaded shaft is disposed through needs to be sufficiently thick to minimize wear and tear with use under the weight of the rest of the system, EMB1, and attachments and should preferably surround at least five to ten threads of the threaded shaft. FIG. 2 shows that there is an ADJSS sub-assembly on each corner of EMB1 (100A).

As mentioned, embodiments of the ADJSS include the ability to be removed, which allows the possibility for the outward bottom facing side of the case floor (129) to be in direct contact with the ground. The ADJSS sub-assembly can be removed by detaching the foot (105, 108) from said substantially threaded shaft connecting said knob (106, 126) and turning said knob (106, 126) in the counterclockwise sense until the substantially threaded shaft backs away from the threaded borehole and be altogether separated from the rest of the system, EMB1. To augment the traction, the embodiments of the bottom surface of the case floor (129) have a high friction lining (e.g., rubber, the synthetic equivalent of rubber, DYCEM®), coating (VHT® TRACKBITE, a.k.a. VHT®), or even one side of a hook and loop fastener (e.g., VELCRO®). The ground in contact with the bottom-facing side of the case floor (129) may also have the same high friction lining, coating, and complementary side of a hook and loop fastener.

Also within the case extension (107) is at least one bore to house the shaft of the retractable pull handle (109). The pull handle (109) has a stop to catch the outside end of the bore so that a pulling force can be applied to the case (101) when EMB1's post tubes (112, 121, 127) are in storage and being transported. During transport, EMB1 (100A) is lifted by the user via said pull handle (109) vertically off the ground at the tube-end so that the wheels (103) engage the ground surface.

EMB1 (100A) can optionally have construction levels (110, 111) comprising dyed liquid in a small clear hexagonally shaped pocket with sufficient gas void fraction to have a visible bubble and level indicators typically in the form of line markings on the outer surface of the hexahedral-shaped level. The exemplary embodiment has one level (110) attached near the top edge of one of said case's side panels (145), by any one of a variety of means and oriented such that when the bubble is in between the level indicators, the pitch angle of the case (101) is at a zero degree or a neutral pitch angle corresponding with a perfectly vertical post as viewed from the side of said case. A second level (111) is fixed on one of the shorter case panels (102, 104) or panels adjoining and orthogonal to the case's side panels (145), which for the exemplary embodiment, is shown in FIGS. 1-7 near the top of the inside surface of the wheel-side panel (102). This second level (111) provides the user feedback on the case roll angle. Said ADJSS can be manipulated to modify both pitch and roll angles of said case (101) and thus the orientation of the tubes (112, 121, 127).

For EMB1 (100A), the post comprises of the base tube (112) which is integrated with or molded as a T-bar element where the spanwise portion of the T-bar (125) forms an axis of rotation for the entire post assembly, as shown in FIG. 2. The spanwise distal ends of the T-bar (125) can be pinned (113) at its axis of rotation or alternatively reside in a molded cylindrical housing in the case (101) so that the only kinematic degree of freedom for the spanwise portion of the T-bar (125) is pure rotation.

For multi-segment telescoping post embodiments, said base tube (112) can have a tube-like cross-section to support bending loads in a mass-efficient manner while also allowing extension tube segments to telescope in and out, as shown in FIGS. 1-5. The first extension tube (121) projecting from said coaxial base tube (112) has a slightly smaller outer diameter than the inner diameter of said base tube (112) to allow telescoping displacement of said first extension tube (121) while portions of said first extension tube (121) are in said base tube (112). Pre-drilled holes are provided in said base tube (112) and first extension tube (121) so that a quick-release lock pin (122) can be disposed through lined-up holes of both said base tube (112) and first extension tube (121) to prevent the first extension tube (121) from sliding relative to said base tube (112) and fix the degree of overall post extension during post deployment. Each segment of a telescoping post embodiment can have markings such as painted lines to help align the holes for the quick-release lock pin (122) to go through. Ideally, the first extension tube (121) will be approximately as long as the base tube (112) and both a little shorter than said case (101) so that tube storage within said case (101) is possible and the maximum length of the overall post can be achieved with the minimum number of tube segments.

Figure 3:
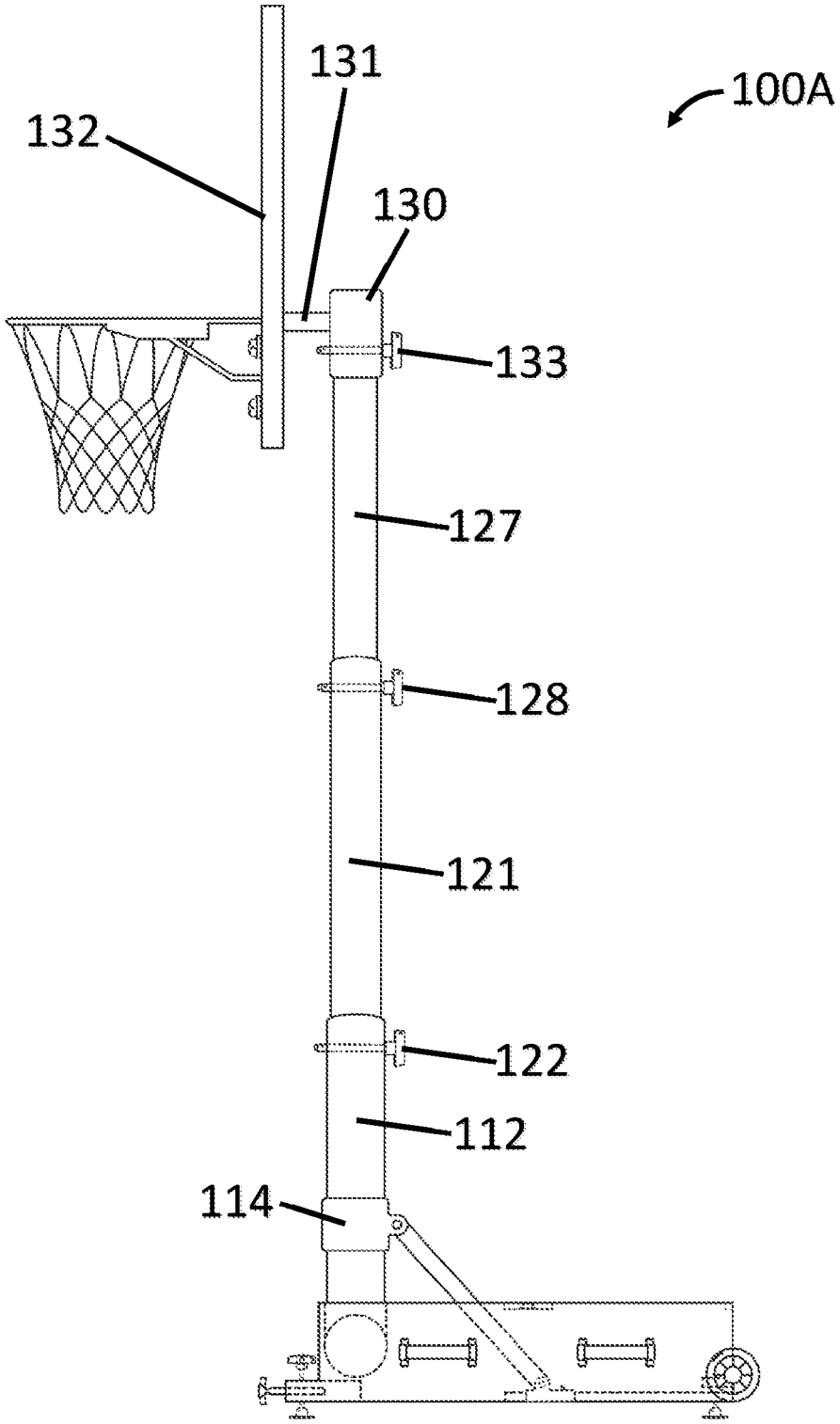
FIG. 3 is a side view of EMB1 with its post in the deployed position and a basketball hoop and backboard attachment.

Additional hollow tube segment embodiments are possible for applications that require a higher-placed attachment. FIGS. 2-3 show an embodiment with a second extension tube (127) with analogous structure and features as said first extension tube (121). This means the second extension tube (127) projecting from said first extension tube (121) has a slightly smaller outer diameter than the inner diameter of said first extension tube (121) to allow telescoping displacement of said second extension tube (127) while a portion of second extension tube (127) is partially inside the first extension tube (121). Pre-drilled holes are provided in said first extension tube (121) and second extension tube (127) so that a quick-release lock pin (128) can be disposed through lined-up holes of both said first extension tube (121) and second extension tube (127) and thereby prevent second extension tube (127) from sliding relative to said first extension tube (121). Each segment of a telescoping multiple segment post embodiment can have markings such as painted lines on the other surface of said tubes (121, 127) to help align the holes for the quick-release lock pin (128) to go through. Other embodiments can allow for more extension tube segments in the manner described for said second extension tube (127).

To prevent rotation of the overall post during use and to help guide the overall post assembly between the stored and deployed position, a collar-connecting rod-slider mechanism is used, said mechanism comprising a collar (114), connecting rod (116), collar-to-connecting rod pin (115), slider (118), connecting rod-to-slider pin (117), and slider track (119). The collar (114) wraps closely around said base tube (112) while still allowing said collar (114) to slide relative to said base tube (112) with both minimum friction and collar-to-base tube gap. Said collar (114) has an eyelet pin bore on wheel-side that said collar-to-connecting rod pin (115) is disposed through. The other end of said connecting rod (116) is attached to said slider (118) via connecting rod-to-slider pin (117) disposed through an eyelet pin bore on said slider (118). Said slider track (119) is securely mounted to the spanwise center of said case floor (129) between the near proximal and wheel-side distal end of said case (101) so said slider (118) sliding on said slider track (119) helps guide the overall post assembly to and from the stored position (as shown in FIG. 2) and fully deployed position (as shown in FIGS. 1, 3, 4, and 5). In the fully deployed position, a quick-release lock pin (120) disposed through lined-up holes on both said slider (118) and said slider track (119) provides the constraining force to prevent rotation of the overall post assembly.

When the overall post is in the stored position (see FIG. 2), said base tube (112) and extension tube segments (121, 127) lie along the spanwise centerline across a substantial length of said case (101) above said slide track (119). For single tube or multiple-tube-segment post embodiments, the top of the overall post can rest on a ledge (123) that extends from the inside facet of the wheel-side panel (102) as shown in FIG. 2.

During storage, the case (101) has extra room for nets, quick-release lock pins, signs, and other items. For embodiments that accommodate basketball or sign applications, the case (101) can be large enough to have the basketball backboard or sign lie flat inside the case (101) without the need to be folded. To prevent interference with other components, ledges extending from the inner facet (not shown) of the case panels can be devised which the basketball backboard or sign rests on and is above the post. Straps (124) or handles can be attached to any of the case panels to facilitate the transport of EMB1 to and from a passenger vehicle or other storage location.

FIG. 3 shows an application embodiment of EMB1 (100A) with a basketball backboard and hoop attachment assembly (130, 131, and 132). All exemplary attachments comprise of an attachment collar or cup-like element (130) wherein said attachment collar or cup-like element (130) has an inner diameter that is slightly larger in diameter than the outer diameter of the top-most post segment (127 in FIG. 3) and the overlapping portion of attachment collar or cup-like element (130) and top-most post segment (127) is long enough to firmly secure the basketball backboard and hoop attachment assembly (130, 131, and 132). A quick-release lock pin (133) can be disposed through lined-up holes between the second extension tube (127) and cup-like element (130) to lock the cup-like element (130) further securely with the second extension tube (127). Markings such as painted lines along the axial direction on the outer visible surfaces of both the attachment collar or cup-like element (130) and second extension tube (127) can facilitate the lining up of the pinholes. Attachments can further extend into the geometry of the application and away from the wheel-side of said case (101), here exemplified by a short attachment extension (131) connecting said collar or cup-like element (130) and basketball backboard and hoop assembly (130, 131, and 132) as shown in FIG. 3. An embodiment of the backboard portion (132) of the basketball and hoop assembly may have a plurality of holes with a smaller diameter than that of a basketball to reduce wind resistance and tip-over proclivities and spaced far enough apart to preserve sufficient structural integrity. To augment stability, weights such as sandbags or equivalent can be placed in the case (101). Case (101) embodiments can include physical provisions (e.g., covers, not shown) to add weights without damaging said collar-connecting rod-slider mechanism (114-120), construction levels (110, 111), and inside-case knobs (126).

Figure 4:
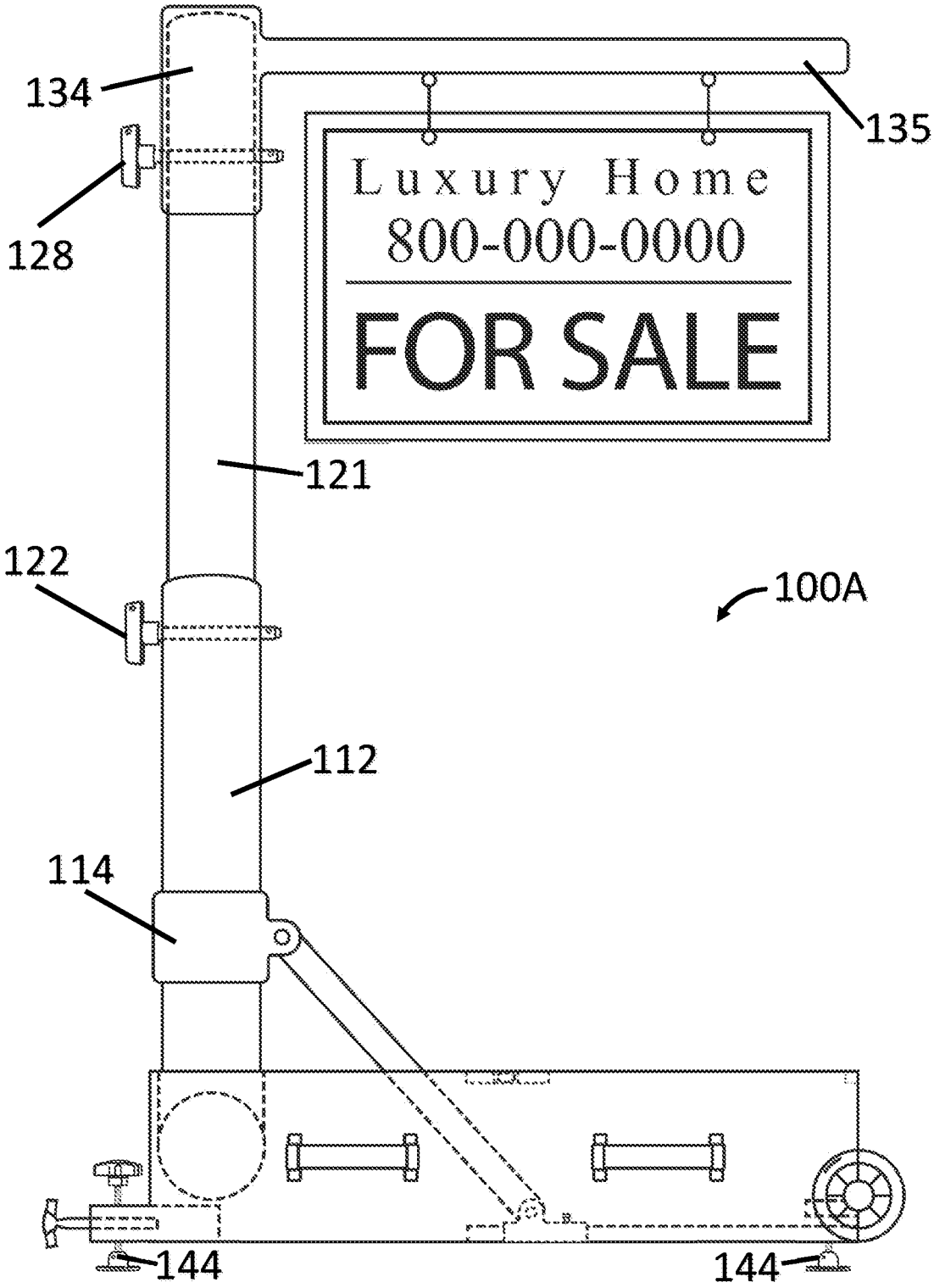
FIG. 4 is a side view of EMB1 with its post in the deployed position and a real estate sign attachment.
Figure 5:
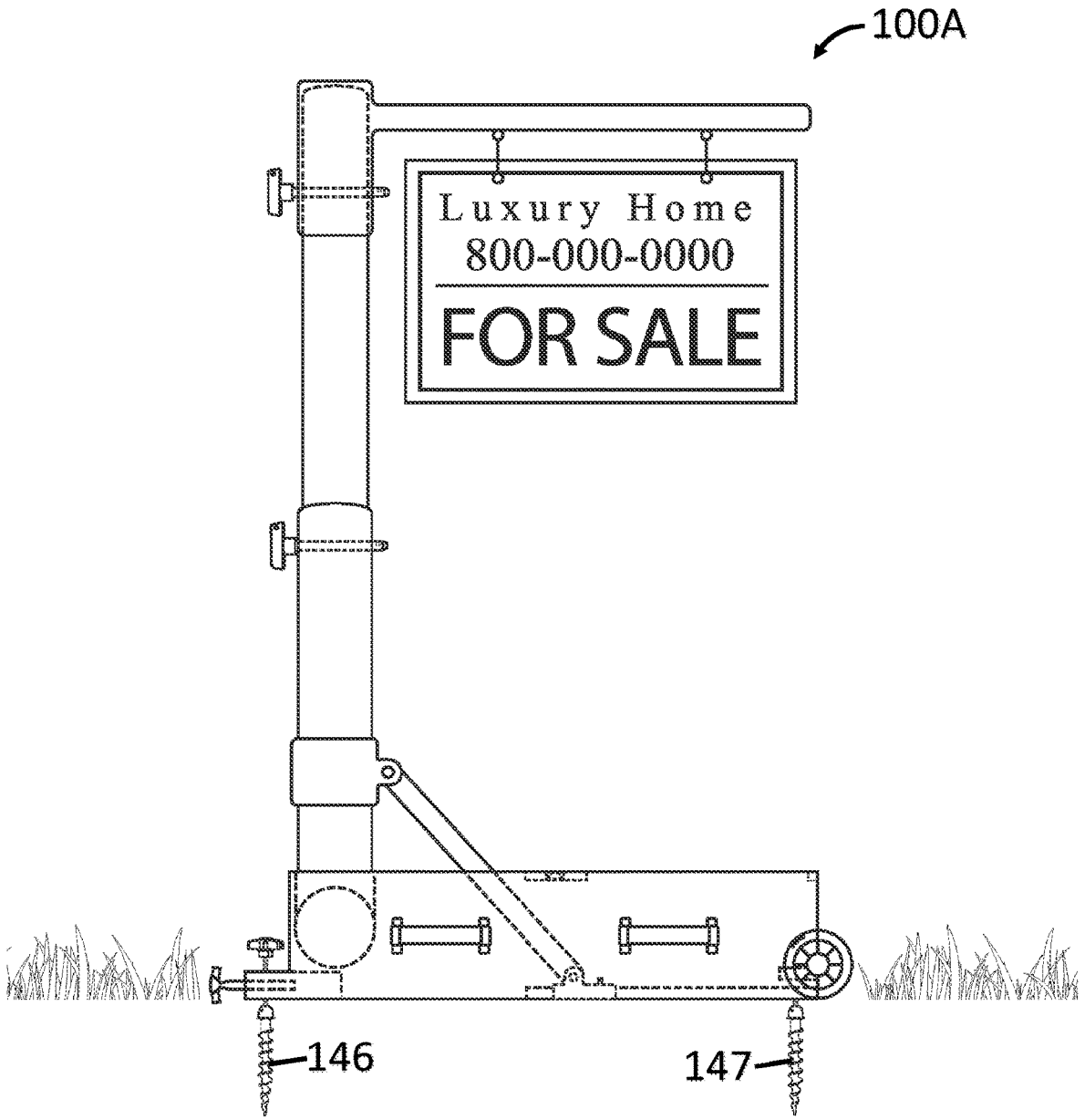
FIG. 5 is a side view of EMB1 with its post in the deployed position and a real estate sign attachment secured into the ground with ground screws

To illustrate the versatility of the present invention, FIGS. 4-5 show EMB1 (100A) with a sign attachment assembly (134, 135). Items attached to this embodiment of the convertible carrying case and securement system for a post can generally be called an "attachment structure," where other examples comprise a lighting fixture, one side of a volleyball or tennis net, batting cage tunnel, boxing punching element, and multi-sports barrier backstop. Compared to the basketball application shown in FIG. 3, no second extension tube (127) is used because the height requirements for the exemplary real estate sign are not as much as a basketball backboard and hoop (132). However, certain compact embodiments of EMB1 may include two or more extension tubes or no extension tube without drawing away from the essence of EMB1's design intent. In the same manner as the basketball application, the attachment begins with an attachment collar or cup-like elements (134) that closely slips around the first extension tube (121) and is deep enough to be secure. A quick-release lock pin (128) can be disposed through lined-up holes present in both the first extension tube (121) and cup-like element (134). Markings such as painted lines along the axial direction on both the cup-like element (134) and the first extension tube (121) can facilitate the lining up of the pinholes. Extending from the collar or cup-like element (134) is a boom (135) or structural member some distance over much of the case's length, where signs can be suspended for easy visibility to the intended audience.

While FIG. 4 shows how EMB1 may be placed over a hard surface, FIG. 5 shows a foot sub-assembly embodiment where EMB1 is placed on soft ground. The plate-like feet (105, 108) shown in FIGS. 1, 3, and 4 may be interchanged with ground screw style feet as shown in FIG. 5 (146, 147) to augment securement. Alternative embodiments to the ground screw style feet (146, 147) comprise a stake, pins, rods, or any equivalent element that can easily be driven into soft ground.

Figure 6:
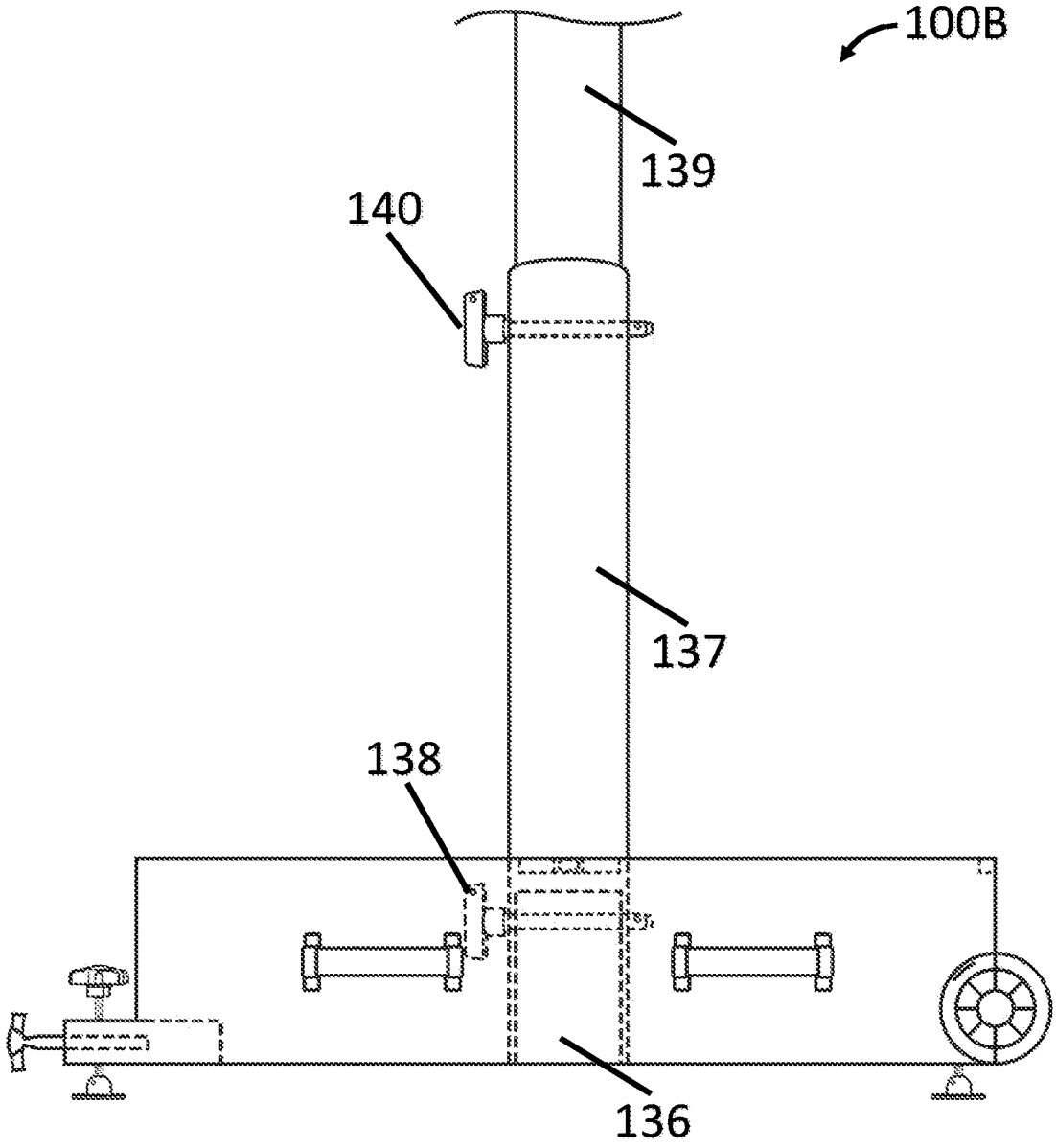
FIG. 6 is a side view of EMB2 with its post in the deployed position.
Figure 7:
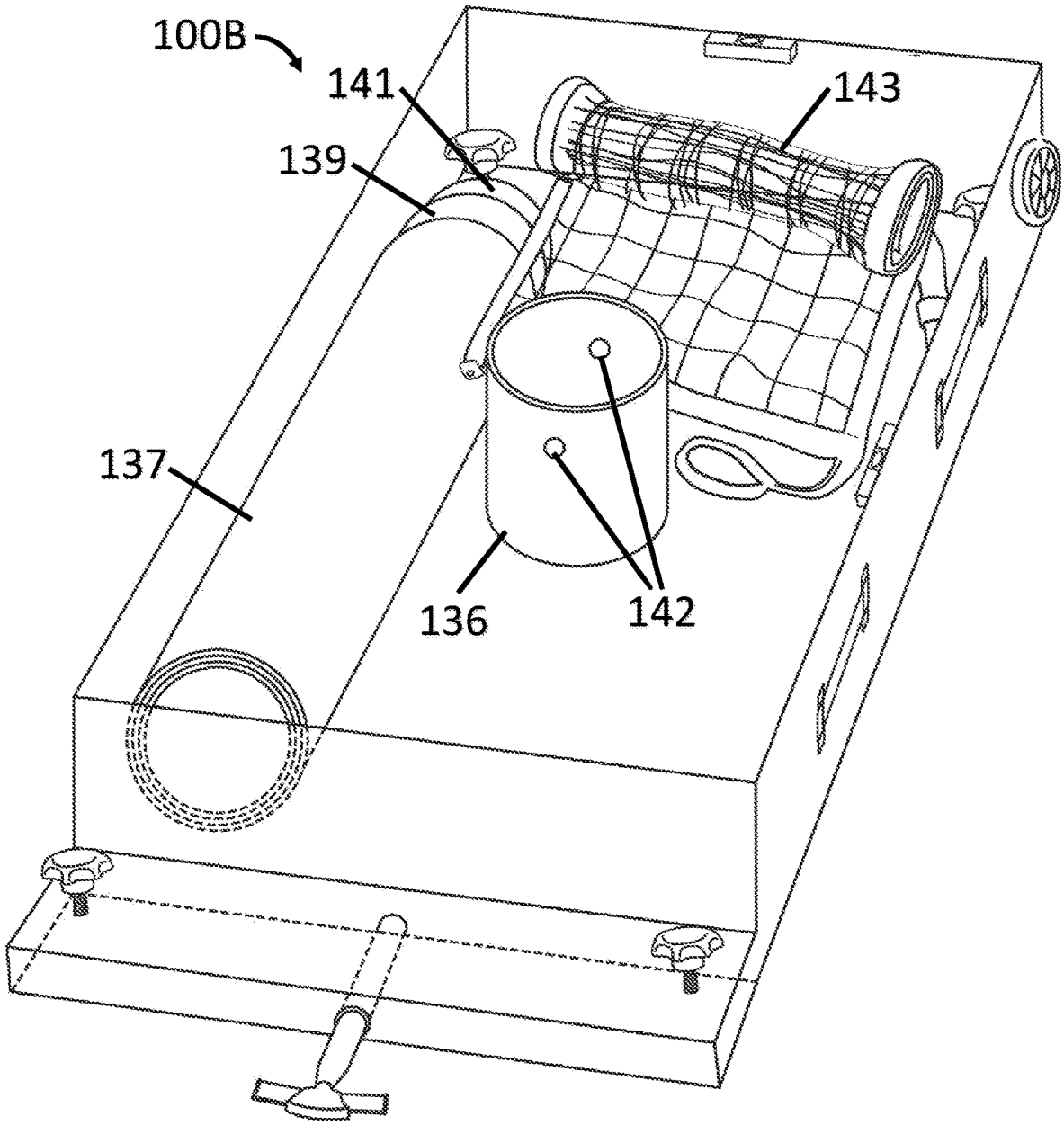
FIG. 7 is an oblique view of EMB2 with its post in the stored position.

II) EMB2 Embodiment (100B, REF. FIGS. 6-7)

Certain applications may require a more proximally located post, as opposed to the offset configuration used in EMB1 (100A). Therefore, a second system embodiment, EMB2 (100B), of the present invention has also been devised, that is identical to EMB1 (100A) in every way except for the location of the post with respect to the case (101) as well as the manner which the post is attached to the case (101). More specifically, EMB2 (100B) proximally locates a stump (136) that is fastened to or structurally integrated with the case (101). The stump (136) can be solid or preferably hollow and tube-like to attain the requisite post-securement without incurring excess mass. Said stump (136) can slide into the circular opening of a separate hollow single-segment tube or base portion (137) of a multiple segment telescoping tube and is fixed together with a quick-release lock pin (138) disposed through lined-up holes present in both said stump (136) and said base tube (137). Alternatively, the outer surface of a separate single-segment tube or base portion (137) of a multiple segment telescoping tube slides into the opening of the hollow stump (136) and is fixed together with a quick-release lock pin (138) disposed through lined-up holes present in both the stump (136) and base tube (137).

Holes (142) for the stump (136) are clearly illustrated in FIGS. 6-7. Markings such as painted lines on both the outer surfaces of the inside surface of said case floor (129) and base tube (137) can facilitate the lining up of the pinholes. The base tube (137) can be part of a multiple segment telescoping post (137, 139, 141), wherein the exemplary embodiment is shown with two additional segments (139, 141), but other overall post embodiments can include fewer or more tubes and quick-release lock pins (140) disposed through lined-up holes of two overlapping co-axial tube segments to prevent overlapping tubes from sliding relative to one another.

As with EMB1, to augment stability, weights can be placed in the case (101). Case (101) embodiments include provisions (e.g., covers, not shown) to add weights without damaging said stump (136), construction levels (110 and 111), and inside-case knobs (126).

FIG. 7 shows the storage of the multiple segment telescoping post (137, 139, and 141) inside the case (101) of EMB2 (100B), placed lying down with the post extension tubes (139, 141) fully retracted. During storage, the case (101) can have extra room for nets, quick-release lock pins, signs, and other items. Items attached to EMB2 can also be generally called an "attachment structure," where further attachment structure examples comprise a lighting fixture, heater, volleyball net, and table tennis net.

Because of the proximal location of the stump in EMB2, a case extension (107) is not necessary. Hence, the ADJSS sub-assembly that shows the knob (106), foot (105), substantially threaded shaft connecting said knob (106), and foot (105) that is disposed through said case extension (107) (see FIG. 2) can for EMB2 be alternatively disposed through the corners of the case floor (129) opposite to the corners where the knobs (126) are situated. Hence the ADJSS for EMB2 can be fully contained within the footprint of the case (101) itself and the pull handle (109) can be extended directly from the case (101).

Figure 8:
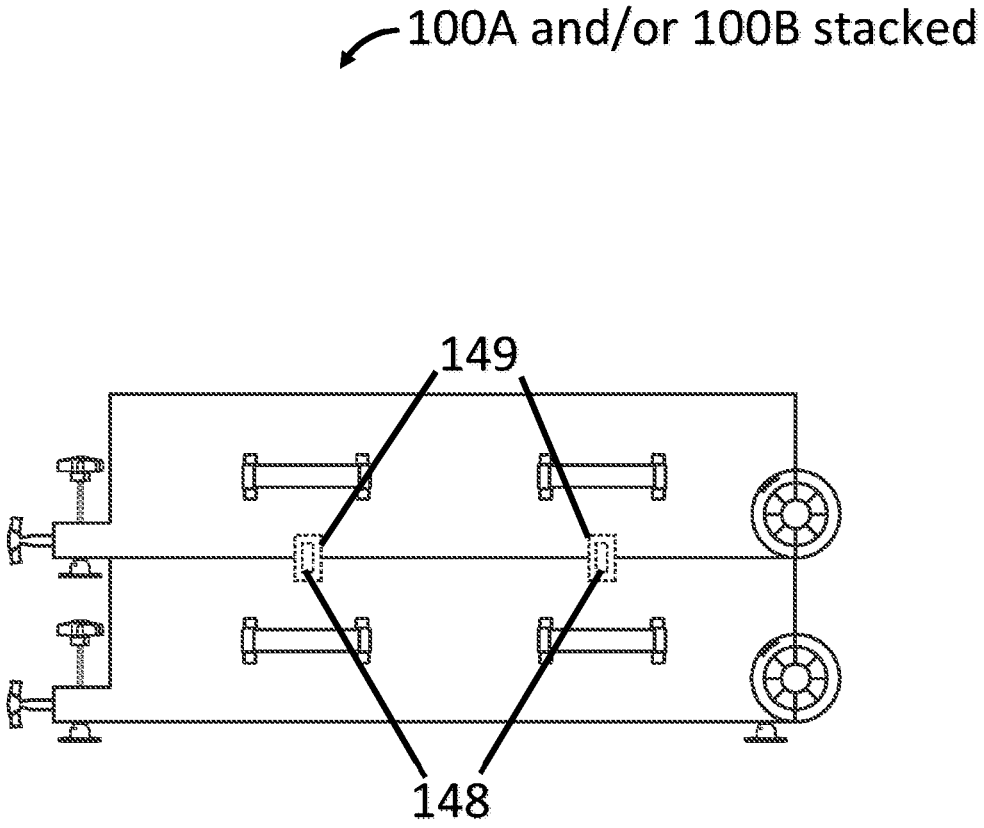
FIG. 8 is a side view of a stacked pair for compact storage and transport, where the coupling embodiment is pegs through holes of each of the separate case panels
Figure 9:
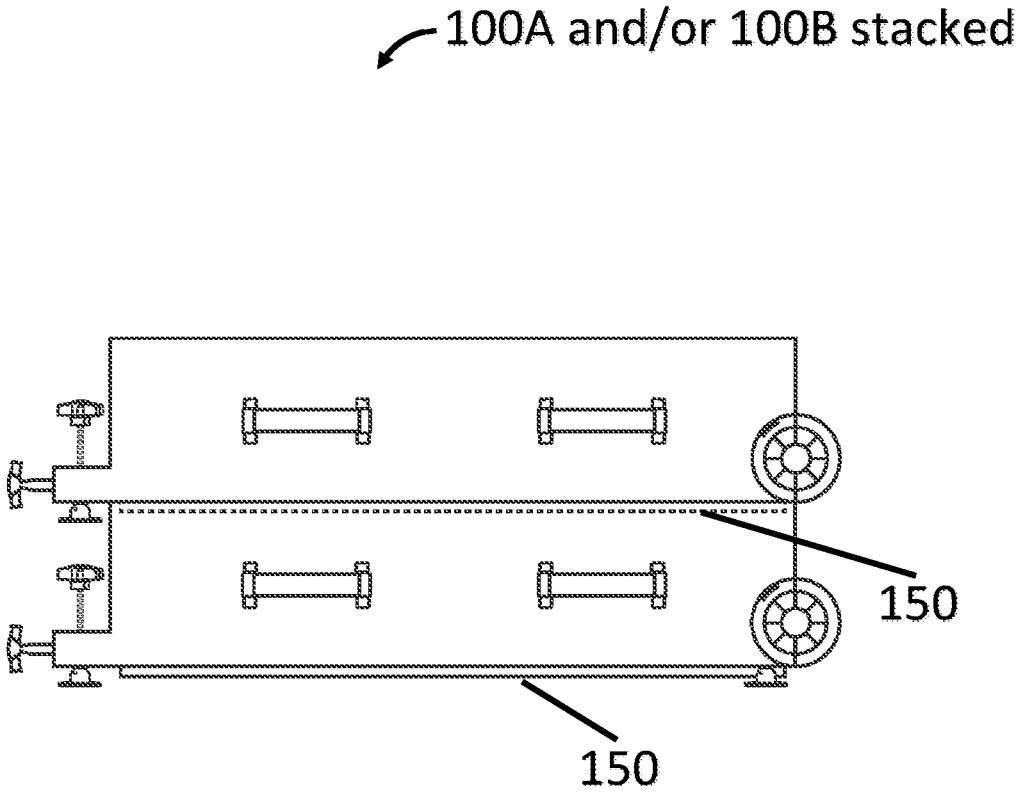
FIG. 9 is a side view of a stacked pair for compact storage and transport, where the coupling embodiment has the floor bulge fit within the upper walls of the case below

III) Coupling Embodiments (REF. FIGS. 8-9)

To facilitate storage and transport embodiments of the present invention include means to group two or more systems. One embodiment, as shown in FIGS. 8-9, is the stackable approach, where either the EMB1 or EMB2 is stacked on top of another EMB1 or EMB2. Within this embodiment, there are several "sub-embodiments" that enable the coupling. FIG. 8 shows a plurality of peg accommodating boreholes (149) along the top and bottom surfaces of at least two non-floor cases panels (145 shown, but 102 and 104 are possible too) of each case to enable vertical stacking of separate cases when a peg (148) is situated in each of the aligned peg-accommodating boreholes along the mating surfaces of the corresponding panels of each of the stacked cases. The boreholes (149) can be slightly flared or opened up to provide peg guidance during the engagement. Alternatively, the case's floor has a thin box-like bulge (150) over a substantial but not full portion of the case floor's area, manufactured through molding or stamping, dimensioned so that the bulge (150) fits just within the inner walls of the case panels (102, 104, 145) of a separate case below it to enable vertical stacking of separate cases, as shown in FIG. 9. If the case (101) has an optional lid or sixth panel that is substantially parallel to the case's floor panel and configurable to close the case into a full hexagon, said lid can have a complementary depression topology of very slightly larger width and length than said bulge so that the bulge can engage the lid's depression. The lid's depression is manufactured by molding or stamping.

Alternatively, a side-by-side coupling embodiment is achieved by a plurality of large binder-style clips, preferably spring metal or high elastic modulus synthetic material, around one of the side panels (145) of a case (101) with a side panel (145) of a separate case. An alternative side-by-side coupling embodiment would comprise of a plurality of holes on coupled case side panels and a plurality of quick-release lock pins each disposed through one of the lined-up holes the side panels (145) of the coupled cases (101).

IV) Preferred Materials and Geometry

The cases (101) of EMB1 (100A) and EMB2 (100B) can be made of a broad variety of plastics, metal, vinyl, fiberglass, or carbon fiber depending on the application. Tubes/stumps (112, 121, 127, 136, 137, 139, 141, collars (114), T-bar (125), cup-like attachment elements (130 and 134), boom (135), pin shafts (113, 115, 117), or pin portions of quick-release lock pins (120, 122, 128, 133, 138, 140), attachment extension (131), connecting rod (116), slider (118), slider rail (119), threaded shaft of each ADJSS sub-assembly, and shaft attached to pull handle (109) are preferably made from metal with high strength to weight ratio, such as aluminum, but materials like plastic or carbon-fiber may be alternatively be used if the application sees fit. The ledge (123), pull handle (109), each wheel excluding the tire (103), feet (105, 108) of each ADJSS sub-assembly, the handle of quick-release lock pins (120, 122, 128, 133, 138, 140) as well as the turning knob (106, 126) for each ADJSS sub-assembly can be made from a broad variety of plastics or vinyl. An optional embodiment can include a rubber or vinyl coating for additional grip. The tire portion of said wheel (103) and bottom surface of each ADJSS foot (105, 108) can be made of rubber or synthetic rubber for high grip. The case straps (124) or handles can be made from woven textile, a variety of plastics, or metal depending on the intended application.

For parts where one component slides relative to another like two co-axial tubes or a collar around a tube or a cup-like element around a tube, the gap between the sliding surfaces should be large enough to allow for smooth low friction sliding but small enough to avoid "slop" that excessive part-to-part gaps can introduce. The dimensional clearances that support such characteristics are on the order of dozens of thousandths of an inch to a few tenths of an inch.

The dimensions including the thickness of the case panels (102, 104, 145) depend on the material used but are such that sufficient rigidity for the application is provided. Furthermore, the case panels (102, 104, 145) may be completely flat, reinforced with ribbed topology, or be internally corrugated, or fiber-reinforced.

Many alterations and modifications may be made by those having ordinary skill in the art without departing from the spirit and scope of the embodiment. Therefore, it must be understood that the illustrated embodiment has been set forth only for the purposes of example and that it should not be taken as limiting the embodiment as defined by the following claims. For example, notwithstanding the fact that the elements of a claim are set forth below in a certain combination, it must be expressly understood that the embodiment includes other combinations of fewer, more, or different elements, which are disclosed herein even when not initially claimed in such combinations.

DYCEM® is a registered trademark of Dycem Limited.

VELCRO® is a registered trademark of Velcro BVBA.

VHT® is a registered trademark of Sperex Corporation.

What is claimed is:

1. A convertible carrying case and securement system for a post comprising:

a case, further comprising at least five contiguous panels that form a hexahedral volume;

a retractable pull handle on one end of said case;

at least one pair of wheels on the distal end of said case at the opposite end of said retractable pull handle;

wherein said panels comprise a floor, two side panels, a wheel-side panel closest to said pair of wheels, and a panel parallel to said wheel-side panel but connecting the opposite edges of said side panels ("handle-end panel");

a post comprising a rotatable base tube;

a collar-connecting rod-slider mechanism comprising a collar, a connecting rod, a collar-to-connecting rod pin, a slider, a connecting rod-to-slider pin, and a slider track that is attached to said floor;

wherein said collar wraps around said base tube with a gap that allows said collar to slide freely relative to said base tube;

said collar having an eyelet pin bore that said collar-to-connecting rod pin is disposed through;

wherein an end of the said connecting rod is attached to the said slider via said connecting rod-to-slider pin disposed through an eyelet pin bore on said slider;

said slider track is mounted to a spanwise center of said case floor between a proximal and a wheel-side distal end of said case so said slider sliding on said slider track guides the base tube to and from a stored position and a fully deployed position.

2. The system of claim 1, further comprising a plurality of adjustable support structure ("ADJSS") sub-assemblies.

3. The system of claim 1:

wherein said post further comprises at least one or more coaxially located extension tube segments to form an overall telescoping post assembly;

wherein said base tube and extension tube segments have a plurality of holes drilled straight through from one side to the other to allow a pin to be disposed through said holes of said base tube and said holes of said extension tube segment.

4. The system of claim 1, wherein said base tube is integrated with a mechanism that comprises a pin to establish an axis of rotation along the distal end of said base tube located closest to the handle-end panel.

5. The system of claim 4, further comprising a ledge fixed to an inside surface of the wheel-side panel.

6. The system of claim 3, wherein an attachment collar or cup-like element is connected to an attachment extension on one end while an opposite end of the attachment extension furthest from the wheel-side panel is connected to a hangable structure comprising a basketball backboard and hoop assembly, or a lamp, or a sign, or a net, or a space heater.

7. The system of claim 3, wherein an attachment collar or cup-like element is connected to a boom or a structural member.

8. The system of claim 1, wherein said case has a plurality of construction levels each attached to one of said case's inner panel surfaces.

9. The system of claim 8, wherein at least one of said construction levels is attached on the top edge of one of said case's side panels.

10. The system of claim 8, wherein at least one of said construction levels is fixed on the top of the inside surface of the wheel-side panel or the handle-end panel.

11. The system of claim 2:

wherein each of said ADJSS sub-assemblies comprises an adjustment knob, a foot sub-assembly, and a threaded shaft connecting said knob and foot;

wherein each said foot assembly comprises a hemispherical element with a center-top borehole to accommodate a threaded adjuster shaft;

wherein each hemispherical element has another threaded borehole where a fastening element is threaded in and orthogonally engages a shank portion of said threaded adjuster shaft so that said foot is securely fixed to the threaded adjuster shaft.

12. The system of claim 11, wherein each of said hemispherical elements of each said foot assembly is attached to a plate with a rubbery bottom surface or attached to a suction cup, a ground screw, or a stake.

13. The system of claim 11, wherein each knob's top surface comprises a cavity shaped to allow engagement with a socket wrench drive.

14. The system of claim 1, wherein the ground-facing surface of said case floor is lined with a rubbery material, a non-slip polymeric material, a coating that is used to enhance traction of a vehicle tire and a road surface, or one side of a hook and loop fastener.

15. The system of claim 1, wherein a ground-facing surface of said case floor has a box-like bulge over a substantial portion of its area so that the bulge of one case fits just within the side, wheel-side, and handle-end panels of a separate case situated below of said case floor.

16. The system of claim 1, wherein said side panel of one case is coupled to a side panel of another case using at least one large binder style clip.

17. The system of claim 1, wherein each of said case side panels has a plurality of holes, wherein each hole can accommodate a quick-release lock pin for coupling two separate cases side-by-side.

18. The system of claim 1, further comprising a case lid that is parallel to the case's floor panel and configurable to close the case into a full hexagon.

19. The system of claim 18:

wherein the ground-facing surface of said case floor has a box-like bulge over a substantial portion of its area so that the bulge of one case fits within the side, wheel-side, and handle-end panels of a separate but identically designed case below to allow vertical stacking of separate cases;

wherein said lid further comprises a complementary depression topology of a larger width and a larger to allow said bulge to fit within said lid's depression.

20. The system of claim 2:

further comprising four ADJSS sub-assemblies;

wherein each ADJSS sub-assembly is placed at each corner of said case's floor or an extension of said case;

wherein said extension of said case juts out from the bottom portion of the case panel parallel and handle-end panel;

wherein said threaded shaft is disposed through the case floor or an extension to the case with mating threads.

21. The system of claim 1:

wherein said base tube is integrated with or molded as a T-bar element, where a spanwise portion of the T-bar forms an axis of rotation for the entire post assembly;

wherein the spanwise distal ends of the T-bar are pinned or alternatively reside in a molded cylindrical housing in the case so that the only kinematic degree of freedom for the spanwise portion of the T-bar is pure rotation.

22. The system of claim 1, further comprising a plurality of ledges extending from an inner facet of the case's panels where objects hangable by said system can be placed during storage.

23. The system of claim 1;

wherein said slider track comprises a plurality of slider position locking holes along its length;

wherein said slider comprises a hole; and a quick-release lock pin that can be disposed through said hole of said slider and one of the holes of said slider track to lock said slider with said slider track to establish a constraining force that prevents a movement of said slider, said connecting rod, said collar as well as prevents rotation of the overall post assembly after the base tube is placed in its fully deployed position.

24. The system of claim 1 wherein said floor holds a weight or plurality of weights to augment stability against said post from tipping over.

25. A convertible carrying case and securement system for a post comprising:

a case, further comprising at least five contiguous panels that form a hexahedral volume;

a retractable pull handle on one end of said case;

at least one pair of wheels on the distal end of said case at the opposite end of said retractable pull handle;

wherein said panels comprise a floor, two side panels, a wheel-side panel closest to said pair of wheels, and a panel parallel to said wheel-side panel but connecting the opposite edges of said side panels ("handle-end panel");

a post comprising a rotatable base tube;

a collar-connecting rod-slider mechanism comprising a collar, a connecting rod, a collar-to-connecting rod pin, a slider, a connecting rod-to-slider pin, and a slider track that is attached to said floor;

wherein said collar wraps around said base tube with a gap that allows said collar to slide freely relative to said base tube;

said slider track is mounted between a proximal and a wheel-side distal end of said case so said slider sliding on said slider track guides the base tube to and from a stored position and a fully deployed position.

26. The system of claim 25, further comprising:

a plurality of adjustable support structure ("ADJSS") sub-assemblies;

wherein:

each of said ADJSS sub-assemblies comprises an adjustment knob, a foot sub-assembly, and a threaded shaft connecting said knob and foot;

each said foot assembly comprises a hemispherical element with a center-top borehole to accommodate a threaded adjuster shaft;

each hemispherical element has another threaded borehole where a fastening element is threaded in and orthogonally engages a shank portion of said threaded adjuster shaft so that said foot is securely fixed to the threaded adjuster shaft.

27. The system of claim 25:

wherein:

said post further comprises at least one or more coaxially located extension tube segments to form an overall telescoping post assembly;

said base tube and extension tube segments have a plurality of holes drilled straight through from one side to the other to allow a pin to be disposed through said holes of said base tube and said holes of said extension tube segment.

28. The system of claim 25, wherein said base tube is integrated with a mechanism that comprises a pin to establish an axis of rotation along the distal end of said base tube located closest to the handle-end panel and said axis of rotation is at a fixed height within the case.

29. The system of claim 25:

wherein:

said collar comprises an eyelet pin bore that said collar-to-connecting rod pin is disposed through;

an end of the said connecting rod is attached to the said slider via said connecting rod-to-slider pin disposed through an eyelet pin bore on said slider.

30. The system of claim 27, wherein an attachment collar or cup-like element is connected to an attachment extension on one end while an opposite end of the attachment extension furthest from the wheel-side panel is connected to a hangable structure comprising a basketball backboard and hoop assembly, or a lamp, or a sign, or a net, or a space heater.

31. The system of claim 27, wherein an attachment collar or cup-like element is connected to a boom or a structural member.

32. The system of claim 25, wherein said case has a plurality of construction levels each attached to one of said case's inner panel surfaces.

33. The system of claim 26, wherein each of said hemispherical elements of each said foot assembly is attached to a plate with a rubbery bottom surface or attached to a suction cup, a ground screw, or a stake.

34. The system of claim 26, wherein each knob's top surface comprises a cavity shaped to allow engagement with a socket wrench drive.

35. The system of claim 25, wherein the ground-facing surface of said case floor is lined with a rubbery material, a non-slip polymeric material, a coating that is used to enhance traction of a vehicle tire and a road surface, or one side of a hook and loop fastener.

36. The system of claim 25:

wherein:

a ground-facing surface of said case floor has a box-like bulge over a substantial portion of its area so that the bulge of one case fits just within the side, wheel-side, and handle-end panels of a separate case situated below of said case floor;

the ground-facing surface of said case floor has a box-like bulge over a substantial portion of its area so that the bulge of one case fits within the side, wheel-side, and handle-end panels of a separate but identically designed case below to allow vertical stacking of separate cases;

said lid further comprises a complementary depression topology of a larger width and a larger to allow said bulge to fit within said lid's depression.

37. The system of claim 26:

further comprising four ADJSS sub-assemblies;

wherein:

each ADJSS sub-assembly is placed at each corner of said case's floor or an extension of said case;

said extension of said case juts out from the bottom portion of the case panel parallel and handle-end panel;

said threaded shaft is disposed through the case floor or an extension to the case with mating threads.

38. The system of claim 25, further comprising a plurality of ledges extending from an inner facet of the case's panels where objects hangable by said system can be placed during storage.

39. The system of claim 25:

wherein said slider track comprises a plurality of slider position locking holes along its length;

wherein said slider comprises a hole; and a quick-release lock pin that can be disposed through said hole of said slider and one of the holes of said slider track to lock said slider with said slider track to establish a constraining force that prevents a movement of said slider, said connecting rod, said collar as well as prevents rotation of the overall post assembly after the base tube is placed in its fully deployed position.

40. The system of claim 25 wherein said floor holds a weight or plurality of weights to augment stability against said post from tipping.

* * * * *